US006536127B1

(12) United States Patent
Zeeuw et al.

(10) Patent No.: US 6,536,127 B1
(45) Date of Patent: Mar. 25, 2003

(54) METHOD FOR OPTIMIZATION OF J-BACK CONFIGURATION FOR A CHAIR

(75) Inventors: Bryan H. Zeeuw, Lowell, MI (US); Philip E. Crossman, Grand Rapids, MI (US); Steven M. Lynch, Grand Rapids, MI (US); LeRoy B. Johnson, Lowell, MI (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/952,793

(22) Filed: Sep. 14, 2001

(51) Int. Cl.[7] ..... G01B 5/20; A47C 31/00

(52) U.S. Cl. ..... 33/545; 33/600; 33/1 BB; 297/217.2

(58) Field of Search ..... 33/545, 546, 561.1, 33/600, 1 BB, 511; 702/85, 94, 33, 41, 42, 43, 113, 105, 119, 123, 150, 151, 153, 183; 297/452.28, 217.2; 73/865.9

(56) References Cited

U.S. PATENT DOCUMENTS 2,301,841 A * 11/1942 Zeder ..... 33/561.1
2,807,089 A * 9/1957 Lewsi, Jr. ..... 297/217.2
4,890,235 A * 12/1989 Reger et al. ..... 297/452.28
5,193,285 A * 3/1993 Heinrich et al. ..... 33/561.1
5,456,019 A * 10/1995 Dowell et al. ..... 33/600
5,564,195 A 10/1996 Kokot et al.
5,575,534 A 11/1996 Yu
5,737,845 A * 4/1998 Marasus ..... 33/545
5,995,912 A * 11/1999 DeWolf et al. ..... 702/85
6,010,189 A * 1/2000 Hybarger et al. ..... 297/300.8
6,027,168 A * 2/2000 Crossman et al. ..... 297/337

OTHER PUBLICATIONS

"Universal Measurement Procedure for the Use of BIFMA Chair Measuring Device (CMD)," The Business and Institutional Furniture Manufacturer's Association, Rev. Jan. 18, 1998, 29 pages.

* cited by examiner

*Primary Examiner*—Diego Gutierrez
*Assistant Examiner*—Madeline Gonzalez
(74) *Attorney, Agent, or Firm*—Shook, Hardy & Bacon LLP

(57) ABSTRACT

A J-back calibration device is adapted to vary respective positions of the seat and the back on a chair to which it is removedly attached. A chair measurement device is mounted to the seat of the chair and is adapted to take measurements of the chair given a set position of the J-back calibration device. A design of experiments software is provided with test condition information including the variable positions of the J-back calibration device and measurements from the chair measurement device. The software generates a table of configuration settings for the J-back calibration device at which shirt-pull and bridging or other such variable sought to be optimized can be measured and provided to the software. Through graphical and other analytical tools, optimal configuration settings for the variable positions of the J-back calibration device are determined. The J-back of a chair is adapted to these calibrated settings.

13 Claims, 8 Drawing Sheets

METHOD FOR OPTIMIZATION OF J-BACK CONFIGURATION FOR A CHAIR

STATEMENT REGARDING FEDERALLY SPONSORED RESEARCH OR DEVELOPMENT

Not Applicable.

CROSS REFERENCE TO RELATED APPLICATIONS

Not Applicable.

TECHNICAL FIELD

This invention relates to a chair having a J-back support mechanism between the back and the seat of the chair and, more particularly, to a method of optimizing the configuration of the J-back for the chair.

BACKGROUND OF THE INVENTION

Chairs having seats and backs that are separate, but connected, are well known in the art. Some of these chairs have what is known as a "J-back" that is used to connect the seat to the back. The configuration of the J-back thus determines the location of the back relative to the seat. Therefore, the geometry of the J-back is of paramount importance in determining the overall comfort of a person sitting within the chair. These J-backs are used in chairs where the back moves in direct proportion to the seat (non-synchronized tilt mechanisms) and where the back is allowed to move or tilt at a different rate from the seat (synchronized tilt mechanisms).

In the design of chairs, and particularly chairs with synchronized tilt mechanisms, it is desirable to lessen or eliminate two particular conditions. The first condition is known as "bridging." Bridging occurs when the backrest rotates downwardly and rearwardly from the seat to an extent that reduces lumbar support upon tilting, which can reduce the comfort of the user. The second condition is known as "shirt-pull." Shirt-pull occurs as the backrest rotates upwardly and rearwardly from the seat during tilting. In other words, shirt-pull occurs during the normal recline and return of the backrest. As this motion occurs, the shirt of the person sitting in the chair has a tendency to untuck during tilting, which is undesirable.

Therefore, in designing chairs, it is necessary to consider these two conditions and to attempt to minimize the occurrence or severity of the two conditions as much as possible. Traditionally, this design effort involved constructing a chair having a given tilt mechanism, seat, back and J-back. A person of average build would then sit in the chair and evaluate the overall comfort, bridging and shirt-pull that the user experienced. The configuration of the J-back could then be altered based upon the user's input of the conditions experienced, and the process would continue until the user experienced an acceptable level of comfort when using the chair. Such a design process, however, is both subjective and time-consuming.

It is known within the art to utilize a J-back calibration device to reduce the time required between iterations of the design process. The J-back calibration device allows the chair designers to simulate a J-back and quickly change the configuration of the J-back shape between iterations. In other words, the J-back calibration device assists the designers by allowing them to change the shape and configuration of the J-back during the design process. The J-back calibration device thus allows the relationship between the chair seat and the chair back to be changed, both in distance and in angles. As the J-back calibration device is changed, the chair designers have a person sit in the chair, as changed, to evaluate the comfort of the chair, as well as the shirt-pull and bridging experienced. Once an acceptable comfort level has been achieved, the chair designers use the shape and dimensions of the J-back calibration device from the last iteration to design the J-back for the chair. While the use of the J-back calibration device has decreased the time needed in the design process, it does nothing to address the subjectivity involved in the design process. Moreover, the use of the J-back calibration device relies upon the chair designers to know which distances and angles to change on the J-back calibration device to increase the comfort of the user and to reduce shirt-pull and bridging.

Another device that is known within the art is referred to as a "chair measurement device" or "CMD." The CMD and its method of operation are described in U.S. Pat. No. 5,564,195 issued to Kokot et al., and assigned to The Business and Institutional Furniture Manufacturers Association. The CMD is useful in measuring the amount of shirt-pull and bridging that occur in a given chair configuration. Thus, the CMD can be used to provide more objective information about two of the major design considerations. The CMD does not, however, reduce the design time of the chair, and does not offer any guidance to the chair designers as to how to reduce the shirt-pull and bridging that may be occurring.

Accordingly, there exists a need for a method in the design of J-backs for use on chairs which overcomes the above drawbacks and deficiencies. More specifically, a method is needed that reduces the design time required for a particular J-back associated with a given chair seat and back, that reduces the subjectivity of the design process and that guides chair designers in the proper configuration of the J-back.

SUMMARY OF THE INVENTION

It is an object of the present invention to provide a method for optimizing the configuration of a J-back for a chair that reduces the time needed to design a J-back resulting in a minimum amount of shirt-pull and bridging.

It is a further object of this invention to provide a method for optimizing the configuration of a J-back for a chair by reducing the subjectivity involved in the design process.

According to the present invention, the foregoing and other objects are obtained by a method that combines the measurements obtained from a CMD, the settings and adjustments available with a J-back calibration, and the analysis that can be provided with a Design of Experiments (DOE) software or other similar statistical analysis and plotting software.

Additional objects, advantages, and novel features of the invention will be set forth in part in the description which follows, and in part will become apparent to those skilled in the practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

In the accompanying drawings which form a part of the specification and which are to be read in conjunction there-with and in which like reference numerals are used to indicate like parts in the various views.

DETAILED DESCRIPTION OF THE INVENTION

Figure 1:
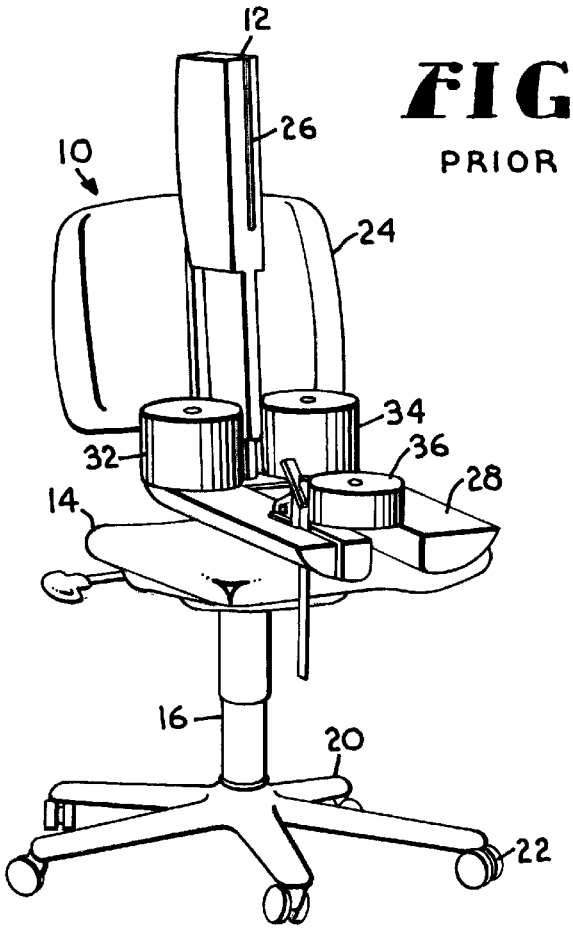
FIG. 1. PRIOR ART
FIG. 1 is a perspective view of a chair measurement device positioned in a chair.
Figure 2:
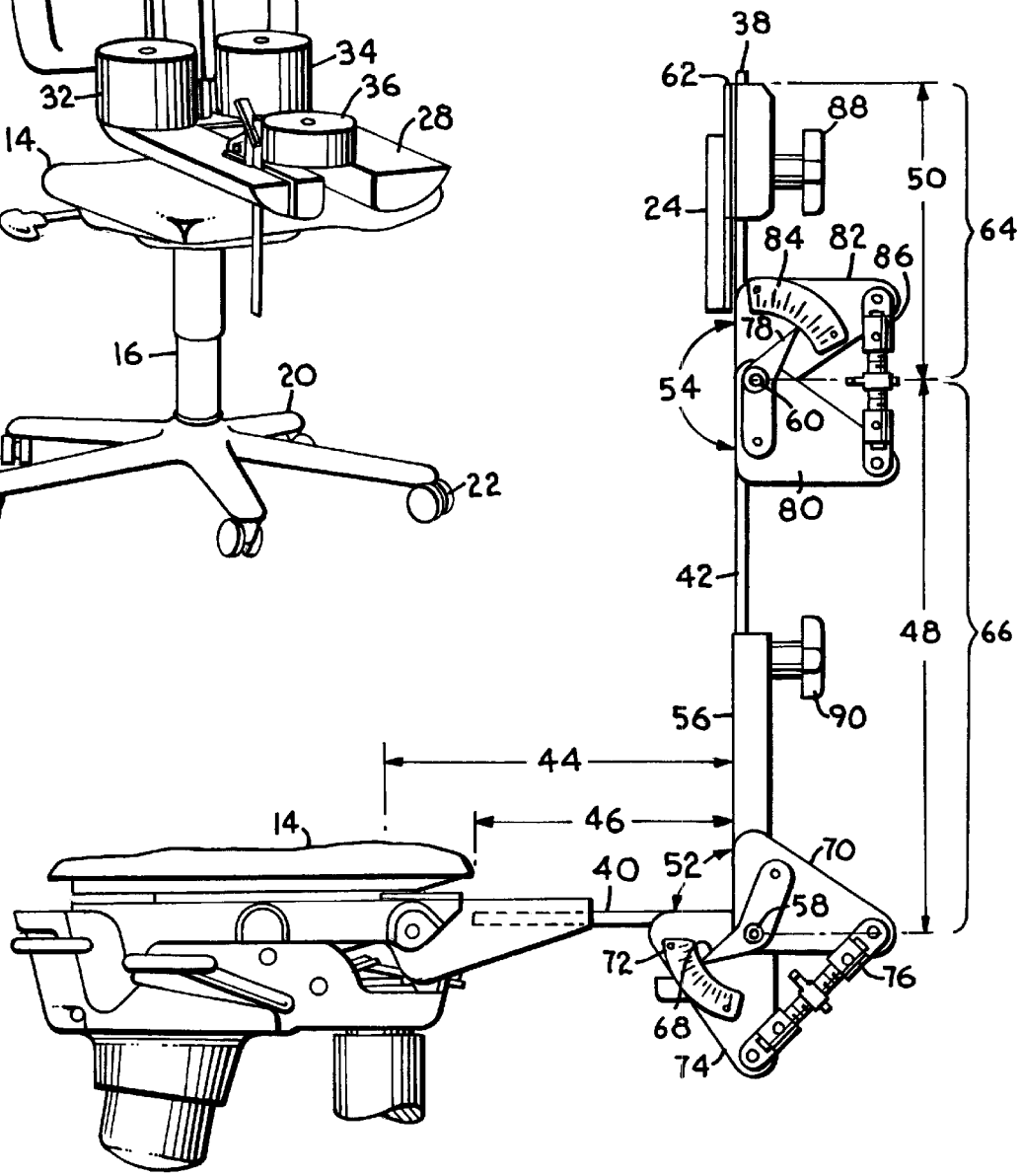
FIG. 2. PRIOR ART
FIG. 2 is a side elevation view of a J-back Calibrator device attached to the seat portion of a chair, only selected portions of the chair being shown.

Referring initially to FIG. 1, a chair upon which the method of the present invention may be practiced is indicated by the reference numeral 10. A chair measurement device 12 (CMD) is shown in place on the chair 10 in a location allowing repeated and reliable measurement of conditions such as shirt-pull and bridging. The chair 10 is sized and weighted based on the characteristics of the human body of a predetermined size. The chair 10 includes a seat 14 supported by a base 16. Base 16 may include a tilt mechanism 18, as best seen in FIG. 2. Mechanism 18 may be any of a number of commercially available chair tilt mechanisms. Base 16 also includes a pedestal support 20, which may be equipped with casters 22. A backrest 24 is coupled to seat 14, through mechanism 18. The backrest 24 is coupled to seat 14 through a J-back mechanism. The present invention, as is more fully described below, provides a method to efficiently design the shape and configuration of the J-back for optimal comfort of the user.

The CMD 12 includes an upright member 26 that is pivotally connected to a base 28. An elastic member 30 extends between upright member 26 and base 28 for engaging and consistently locating device 12 on chair 10. The total weight and weight distribution of a human body are simulated by weights 32, 34, 36. As more fully described below, the CMD 12 is utilized to measure the shirt-pull and bridging that occur in chair 10 given a set J-back configuration. As previously discussed, both shirt-pull and bridging vary with the adjustment of the chair seat 14 and backrest 24 relative to one another. The relationship between the path of travel followed by the seat 14 and backrest 24 during tilting of the backrest 24 is dictated in part by the placement of the pivot axes of the seat 14 and backrest 24, and in part by the manner in which the seat 14 and backrest 24 are linked to one another by the J-back. By adjusting these parameters, it is possible to synchronize the seat 14 and backrest 24 movement through a proper configuration of the J-back to maximize the ergonomics of the chair.

To optimize the J-back configuration, the CMD 12 is used in conjunction with a J-back calibrator and a Design of Experiments Software (DOE) package. Referring to FIG. 2, a J-back calibrator device 38 is removably attached by a horizontal member 40 to seat 14. Backrest 24 is removably coupled to J-back calibrator 38 by a vertical member 42.

J-back calibrator is thus used in place of the J-back for the chair 10. As will be described below, J-back calibrator 38 may be adjusted into a great number of different configurations, by adjusting a number of different variables. Measurements of these variables relating to the configuration for a chair can then be taken with the aide of the J-back Calibrator 38. These variables are designated as depth 44, back lat 46, lower height 48, upper height 50, tilt 52 and lumbar 54. Depth 44 is the horizontal distance between the rear edge of a user seating in the seat 14 and the lower portion of the backrest 24. Back lat 46 is the distance between the rear edge of the chair seat 14 and the vertical member 42 of the J-back calibrator 38. The angle formed by the vertical member 42 and the horizontal member 40 is referred to as tilt 52. The lower height variable 48 is the vertical distance between a tilt pivot point 58 and a lumbar pivot point 60. The upper height variable 50 is the vertical distance between the lumbar pivot point 60 and a top edge 62 of the J-back calibrator 38. The lumbar variable 54 is the angle formed on the vertical member 42 between an upper section 64 and a lower section 56, of which are pivotally coupled by lumbar pivot point 60. The J-back Calibrator 38 allows the variation of each of the afore-mentioned measurements during experimentation and design of the J-back configuration.

The J-back calibrator 38 is thus used to set each of the afore-mentioned variables, which can then be measured so that the design of the J-back is known after tests are performed. In other words, the J-back calibrator 38 allows measurements to be taken for variables 44–54. To measure tilt 52, an indicating pointer 68 is coupled to a bracket 70 of vertical member 42. As bracket 70 pivots about tilt pivot point 58, pointer 68 will indicate the angle formed between lower section 66 of vertical member 42 and horizontal member 40, along a scale 72 that is located on a bracket 74. This angle is fixed in place using a turnbuckle 76 that extends between brackets 70 and 74. Similarly, lumbar angle 54 is measured with an indicating pointer 78 coupled to a bracket 80 on the upper end of lower section 66. As bracket 80 pivots about lumbar pivot point 60, pointer 78 will indicate the angle formed between upper section 64 and lower section 66. A bracket 82 is coupled to upper section 64 and is provided with a scale 84 that is used in cooperation with pointer 78 to indicate lumbar angle 54. A turnbuckle 86 extends between brackets 80, 82 to hold the angle formed by upper section 64 and lower section 66. The upper height 50 can be varied by loosening a knob 88, repositioning upper section 64 and then retightening knob 88. A similar adjustment can be performed on lower height 48 using a knob 90.

Figure 3:
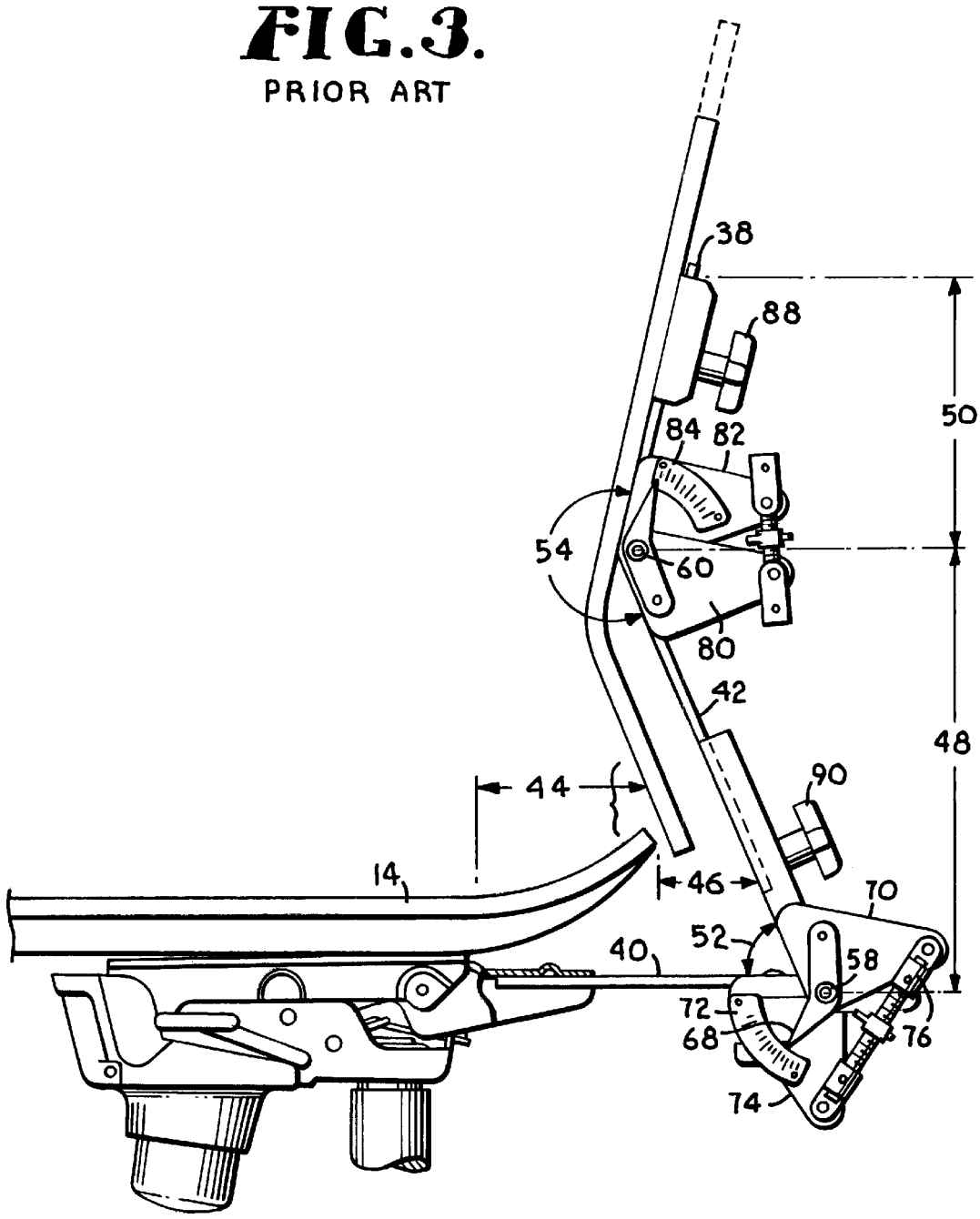
FIG. 3. PRIOR ART
FIG. 3 is a side elevation view of a J-back calibration device, configured with a pre-set tilt angle and lumbar angle, attached to the seat portion of a chair.

Referring to FIG. 3, a chair with a different seat 14 and backrest 24 is illustrated with an alternate configuration of the J-back calibrator 38. As previously discussed, the J-back calibrator 38 is adjustable in a variety of ways such as shown in FIG. 3 wherein, the tilt 52 is a smaller angle and the lumbar 54 is a larger angle than that depicted in FIG. 2. The other measurements such as depth 44, back lat 46, lower height 48 and upper height 50 are also shown and designated in FIG. 3 with the same numeric references used in FIG. 2.

Figure 4:
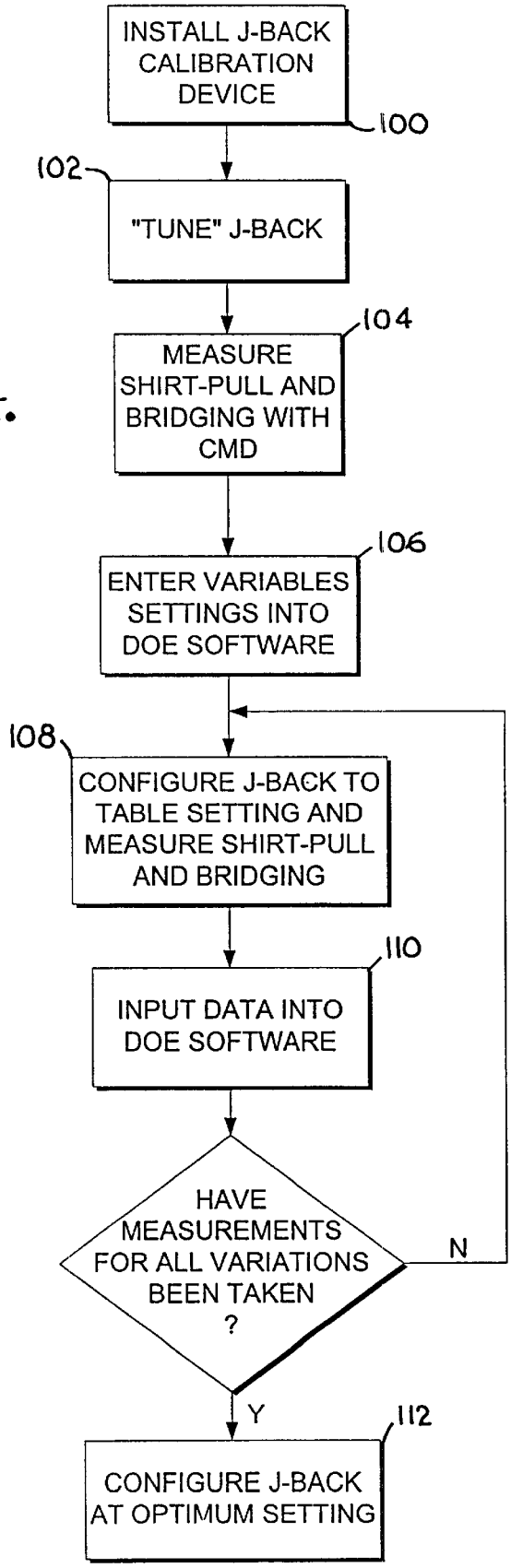
FIG. 4 is a procedural flow chart illustrating the sequence of events employed in an embodiment of the present invention.

Turning to FIG. 4, to the steps utilized in the method of the present invention are shown. As shown, an initial step 100 involves installing the J-back calibrator device 38 on the chair 10 in a manner as previously discussed. In step 102, the J-back calibrator 38 is 'tuned'. In other words, each of the six calibration variables (namely tilt 52, lumbar 54, depth 44, back lat 46, lower height 48 and upper height 50) are adjusted to an initial starting position or setting, and these values are then recorded. Each of the six variables is initially set to values that the chair designer believes will result in a comfortable chair configuration. In step 104, a CMD 12 is placed on the chair 10. The CMD 12 is then used to measure the shirt-pull and bridging effects, given the initial settings of the J-back calibrator 38. The chair designer will then take each variable and determine a range within which to experiment. For example, a "high" setting and a "low" setting can be established for each of the variables on the J-back calibrator 38. The high and low settings are determined both by the physical dimensions of the chair and by the realistic ranges the chair designer believed to be feasible.

In step 106, the settings for each variable are entered into a Design of Experiments (DOE) software in a computer. Using this software, designed experiments can be used to systematically investigate the desired process or product variables that influence shirt pull and bridging. Because resources are limited, it is very important to get the most information from each experiment performed. Well-designed experiments can produce significantly more information and often require fewer runs than unplanned experiments. In addition, a well-designed experiment will ensure the evaluation of the effects identified as important. For example, there may be an interaction between two input variables. An interaction occurs when the effect of one input variable is influenced by the level of another input variable.

The DOE software is a statistical and graphical analysis software. A suitable DOE software is the MINITAB 13™ software, available from Minitab, Inc. Along with the settings for each variable, the chair designer will also input the number parameters sought to be optimized. In this case, shirt-pull and bridging are entered as the parameters sought to be optimized. The chair designer will also input the acceptable margin of error. As a result of these inputs, the DOE software generates a table of "x" variations of the six variables and the user is then required to measure and provide back to the software the readings for shirt-pull and bridging for each of those "x" variations. "X" is essentially determined by the software based on information provided by the experimenter such as the number of variables and the margin of error. "X" will be significantly less than the total number of possible variations of the six variables. The J-back calibrator is then configured to each of the settings of the table as required by the DOE software and both shirt-pull and bridging are measured using the CMD as shown in step 110. This information is entered into the DOE software and the process is repeatedly performed until measurements have been obtained for each variation of the J-back calibrator set-up required by the table generated by the DOE software. The DOE software can then be used to analyze the data so that the optimal J-back configuration can be achieved in step 112. By reviewing and analyzing the various types of charts' that can be generated by the DOE software, the optimal setting for bridging and shirt-pull can be attained as is more fully described best below.

Figure 5A:
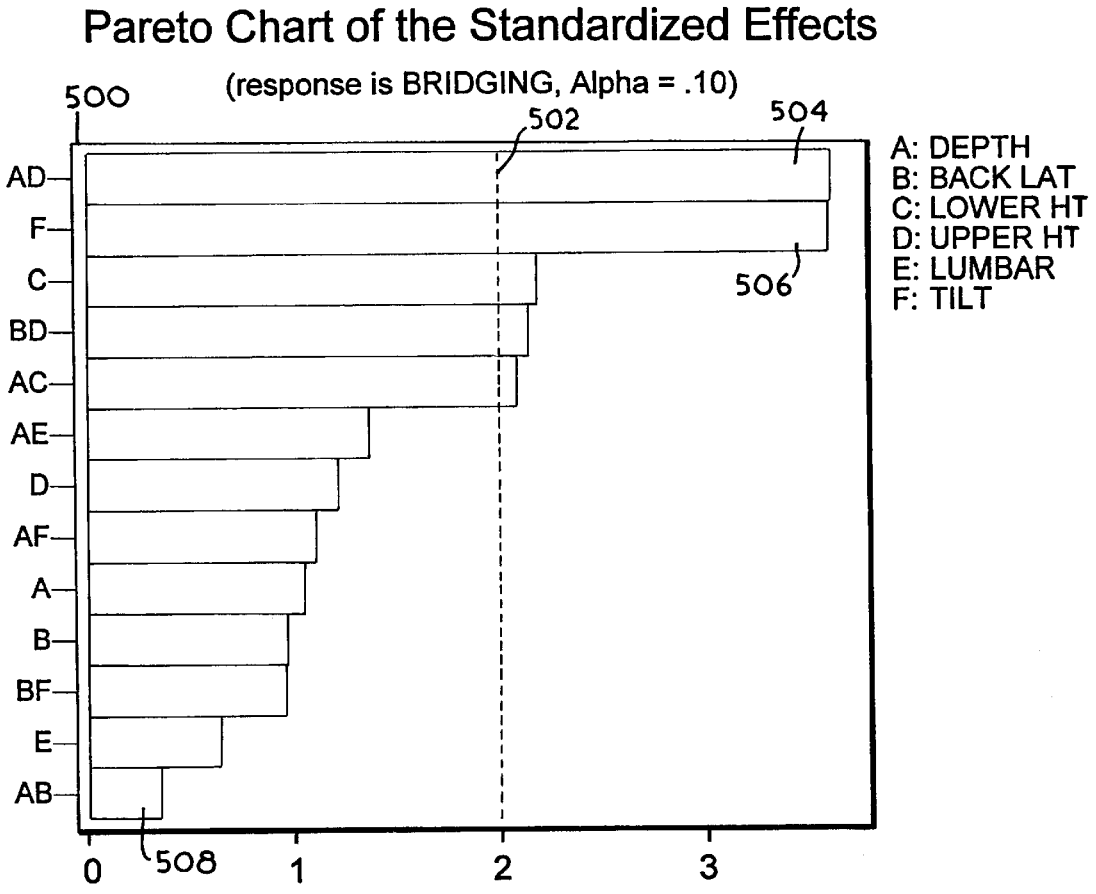
FIG. 5A is an illustrative Pareto chart of the effects certain variables of the J-back calibration have on bridging.
Figure 6:
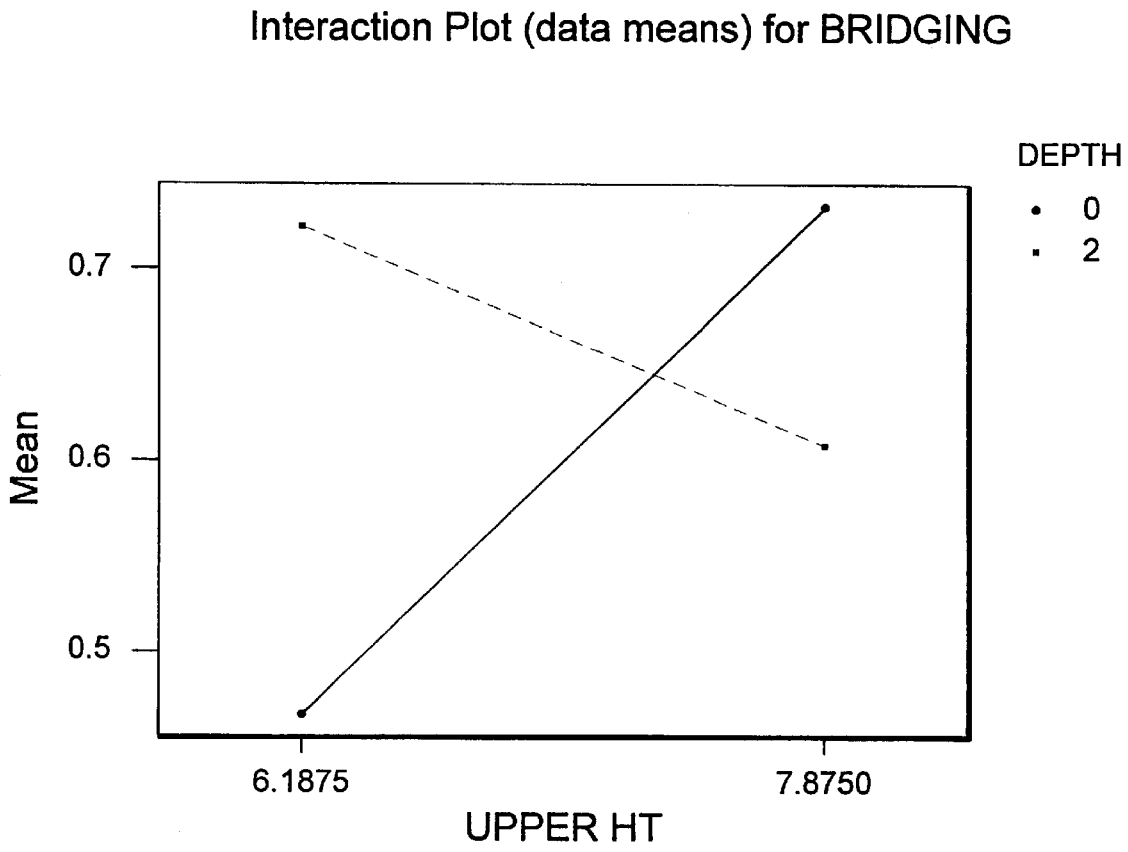
FIG. 6 is an illustrative interaction plot of the depth and upper height parameters of a certain J-back calibrator configuration.

One example of a chart which can be requested of the DOE software is a Pareto chart. A Pareto chart demonstrates which variables have the largest effect on a certain condition. For example in FIG. 5A, a Pareto chart 500 shows the effects that each of the six variables, or combinations of the six variables on bridging. In this case, only second-order effects and lower were requested from the DOE software. The dotted line 502 indicates the threshold of statistical significance. Any bars which are below line 502 are not statistically significant. In other words, these variables can be set at either a "high" setting or a "low" setting, without affecting the bridging condition to a level of statistical significance. This chart thus visually provides information on the combination of variables that have the largest effect on bridging. The variable having the largest effect is indicated by the bar that extends furthest to the right. As shown, the combination of depth 44 and upper height 50 shown as AD 504 and tilt 52 shown by the Pareto chart as F 506 lie furthest to the right, thus having the largest effect on bridging. Therefore, to lessen the effects of bridging, the tilt 52 is best set at the "low" setting, or lesser angle, to minimize bridging. The Pareto chart 500 of FIG. 5A also demonstrates that the depth 44 and upper height 50 variables have a multiplying effect on one another. To determine how to lessen bridging with an adjustment of these two variables, an interaction plot can be requested of the DOE software. An interaction plot of depth 44 and upper height 50 is shown in FIG. 6. FIG. 6 shows that as the upper height 50 increased from 6.1875 inches to 7.875 inches, bridging decreased when the depth 44 was set at 2 inches, but that the bridging increased when the depth was set a 0 inches. The point at which the two lines cross in FIG. 6 demonstrates an optimal point for these two variables, with respect to bridging.

Conversely, the combination of depth and backlat shown as AB 508, has the least and best effect on bridging. As such, the experimenter is able to focus his or her optimization efforts on the items or combinations thereof that would have the most impact on the desired parameter. In this case, the optimization of bridging requires the experimenter to focus on tilt as well as the combination of depth and upper height.

Figure 5B:
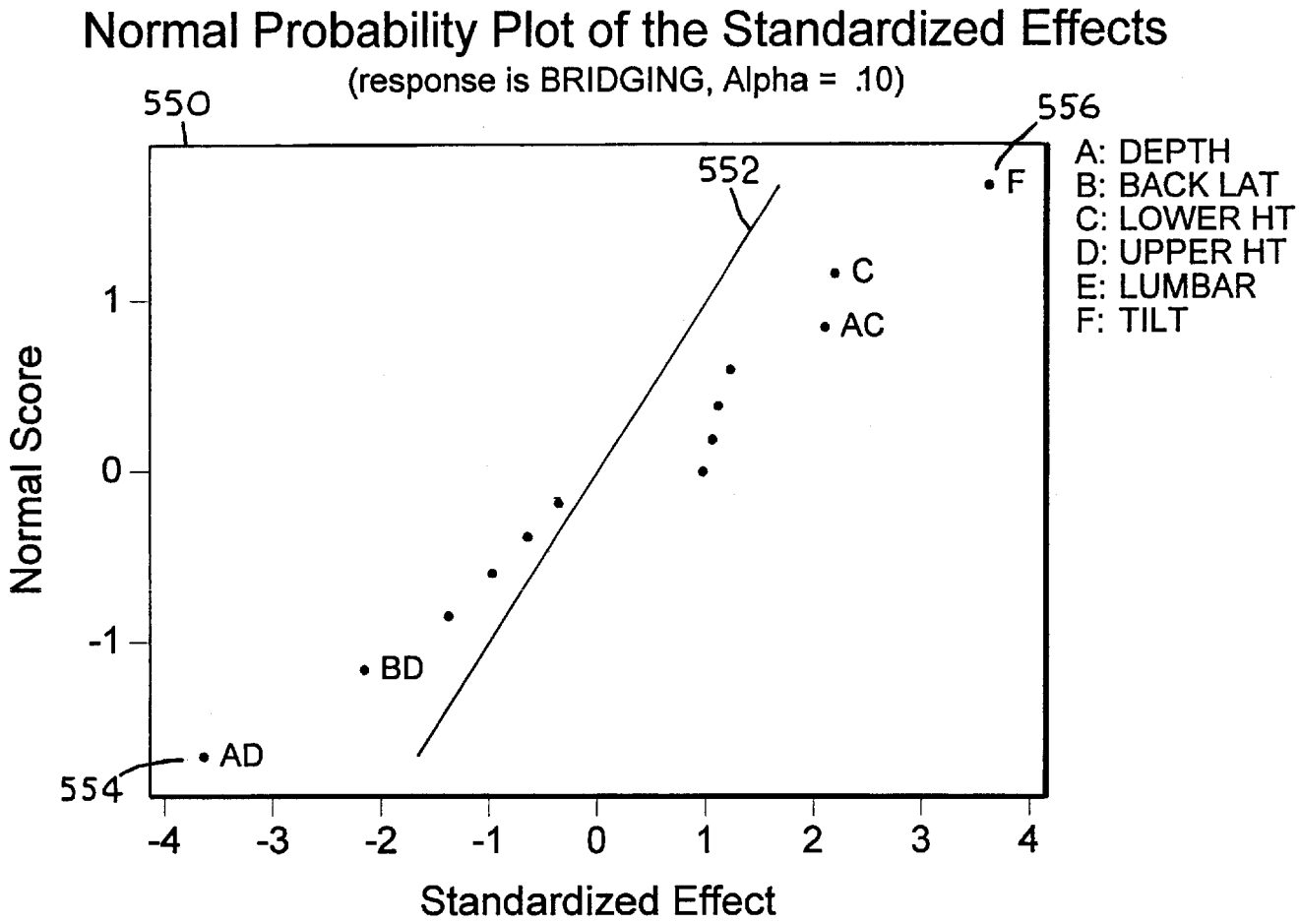
FIG. 5B is an illustrative normal probability plot of the effects certain variables of the J-back calibration have on bridging.

Another example of a chart which can be generated by the DOE software is shown in FIG. 5B. FIG. 5B is a probability chart 550 showing the effects on Bridging resulting from the six variables or combinations thereof. The desired optimal score for bridging is shown with a line 552. This probability chart visually provides information on the variables or the combination of variables that have the largest effect on bridging. On this chart, the further that a particular variable(s) reading is from the line, the greater the effect that this variable(s) has in influencing bridging. In other words, the objective of the experimenter would be to vary the variable(s) such that it closer approaches the line. Because this chart is just another way of presenting the data, it is again seen that tilt 52 and a combination of upper height 50 and depth 44 (point 554) have the largest effect on bridging.

Figure 7A:
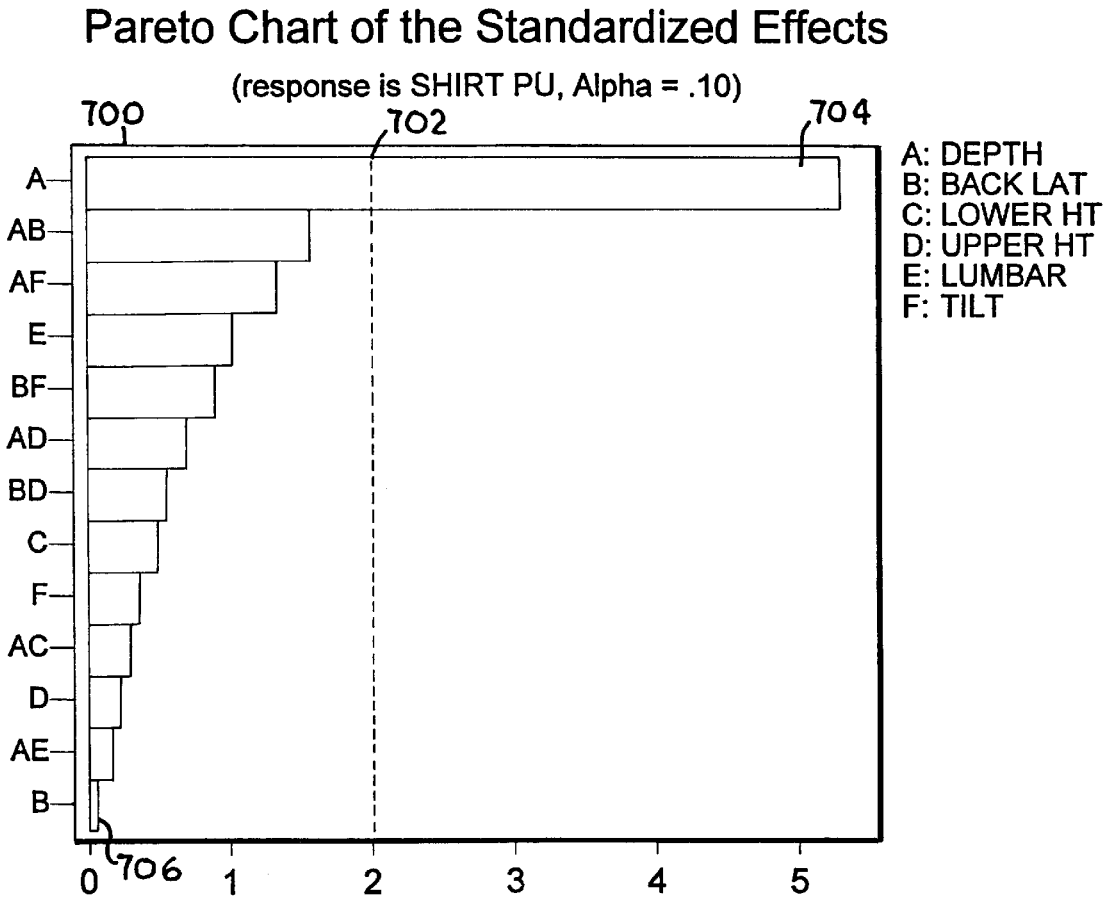
FIG. 7A is an illustrative Pareto chart of the effects certain variables of the J-back calibration have on shirt-pull.
Figure 7B:
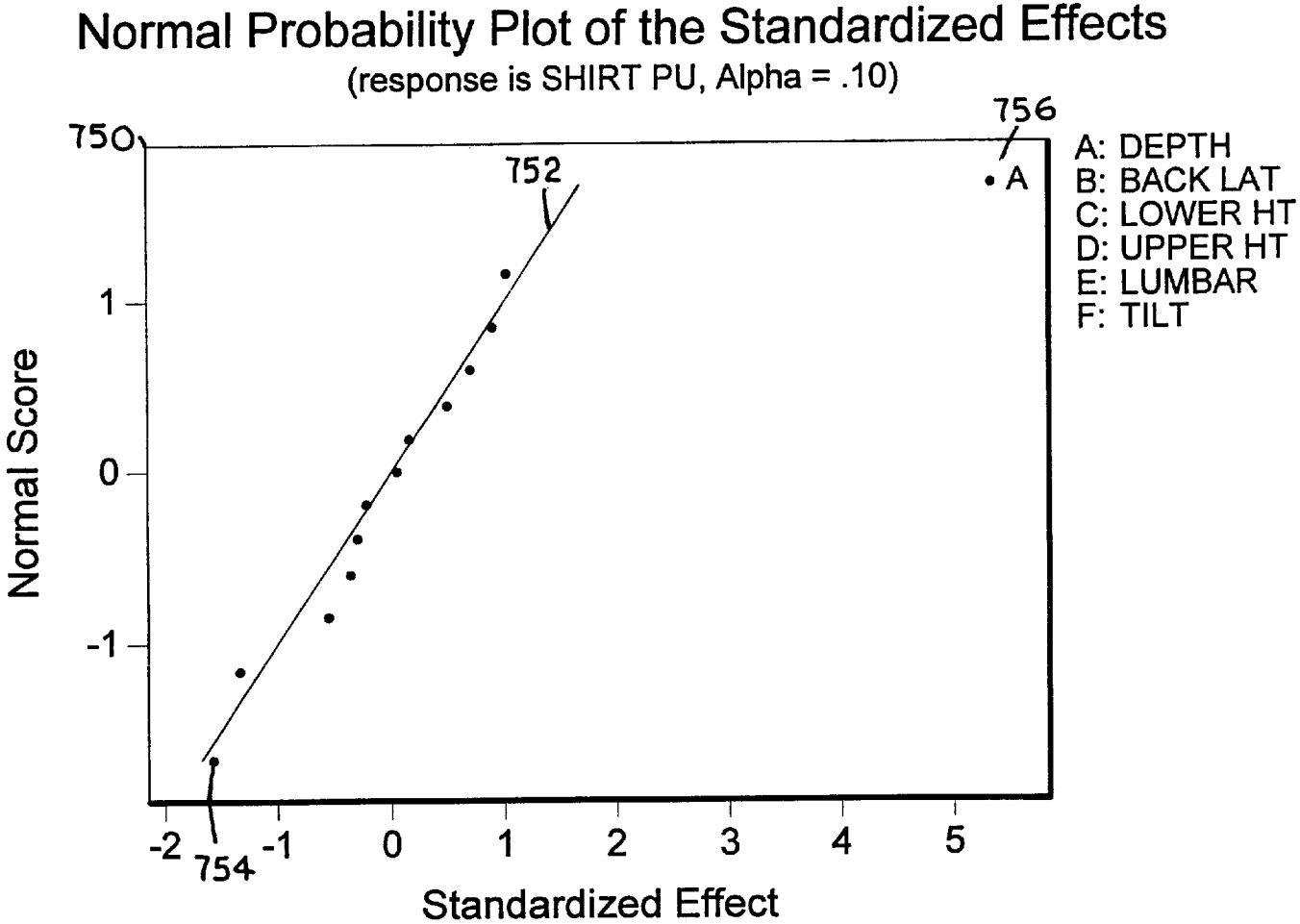
FIG. 7B is an illustrative normal probability plot of the effects certain variables of the J-back calibration have on shirt-pull.

Similar to the previous discussion regarding FIGS. 5A and 5B on the issue of Bridging, the effects of the six variables on shirt-pull can also be plotted as shown in FIGS. 7A and 7B. In FIG. 7A, the pareto chart shows the depth variable 44 (A 704) as having the greatest effect on shirt-pull. Also shown, is the very small effect that backlat 46 (B 706) has on shirt-pull. Therefore, for this J-back, shirt-pull will be minimized by selecting the "low" setting for the depth variable.

Similarly, In FIG. 7B, the DOE software probability chart 750 shows the effects on shirt-pull resulting from combinations of the six variables. The desired optimal score for shirt-pull is shown with a line 752. This chart visually provides information on the combination of variable parameters that have the most probable effect on shirt-pull. As previously stated, the further that a point associated with a particular variable(s) is from the line, the greater the effect that the variable(s) has on influencing a certain condition. In this case, the condition is shirt-pull and the variable depth 756 is the furthest point from the line. This again indicates that depth 44 has the largest effect on shirt-pull. As shown, all the other points in the plot are very close to the line and as such, variations of the associated parameters would be of little interest to the experimenter in decreasing shirt-pull.

Several other types of plots using the information supplied to the DOE software are possible and are contemplated within the scope of this invention. The combined measurements, adjustments and analysis performed within the method of the present invention provide a novel approach to the ultimate optimization of chair designs. Furthermore, it can be seen that the present invention attains all of the objects set forth above.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention. Accordingly, the scope of the present invention is defined by the appended claims rather than the foregoing description.

We claim:

1. A method for determining a desired configuration for a J-back of a chair having a seat, a back and the J-back connecting the seat to the back comprising:

connecting a J-back calibration device to the chair between the seat and the back, said calibration device taking the place of the J-back of the chair, said calibration device adapted to vary respective positions of the seat and the back;

placing a chair measurement device in the seat of the chair, said chair measurement device adapted to take measurements of the chair given a set position of said J-back calibration device;

providing one or more test condition information and measurements from said chair measurement device to a design of experiments software;

obtaining one or more configuration settings from said design of experiments software for said J-back calibration device; and adapting the J-back of the chair to said configuration setting.

2. The method as recited in claim 1 wherein, said chair measurement device is adapted to measure shirt-pull.

3. The method as recited in claim 1 wherein, said chair measurement device is adapted to measure bridging.

4. The method as recited in claim 1 wherein, said test condition information includes a count of adjustable variables on said J-back calibration device and parameters to be optimized.

5. The method as recited in claim 1 wherein said J-back calibration device can vary tilt, lumbar, depth, back lat, lower height and upper height.

6. The method as recited in claim 1 wherein said configuration settings from said design of experiments software include tilt, lumbar, depth, back lat, lower height and upper height values.

7. A method for optimizing the configuration of a J-back for a chair by reducing the subjectivity involved in the design process comprising:

connecting a J-back calibration device to the chair between the seat and the back, said calibration device taking the place of the J-back of the chair, said calibration device adapted to vary respective positions of the seat and the back;

placing a chair measurement device in the seat of the chair, said chair measurement device adapted to take measurements of the chair given a set position of said J-back calibration device;

providing one or more test condition information and measurements from said chair measurement device to a design of experiments software; and configuring the J-back of the chair according to settings resulting from a process utilizing said J-back calibration device, said chair measurement device and said design of experiments software.

8. A method for determining a desired configuration for a J-back of a chair having a seat, a back and the J-back connecting the seat to the back comprising:

connecting a J-back calibration device to the chair between the seat and the back, said calibration device taking the place of the J-back of the chair, said calibration device adapted to vary respective positions of the seat and the back;

placing a chair measurement device in the seat of the chair, said chair measurement device adapted to take measurements of the chair given a set position of said J-back calibration device;

providing one or more test condition information and one or more measurements from said chair measurement device to a design of experiments software;

obtaining one or more configuration settings from said design of experiments software for said J-back calibration device;

configuring said J-back calibration device according to said one or more configuration settings;

obtaining a measurement of shirt-pull and bridging;

providing said measurement of shirt-pull and bridging in association with the appropriate one of said one or more configuration settings to said design of experiments software; and adapting the J-back of the chair to said configuration setting.

9. The method as recited in claim 8 further comprising repeatedly configuring said J-back calibration device, obtaining said measurement of shirt-pull and bridging, and providing said measurement to said design of experiments software for a maximum of the number of said configuration settings obtained from said design of experiments software.

10. The method as recited in claim 8 wherein, said test condition information includes a count of adjustable variables on said J-back calibration device.

11. The method as recited in claim 8 wherein, said test condition information includes varied respective positions on said J-back calibration device.

12. The method as recited in claim 8 wherein said J-back calibration device can vary tilt, lumbar, depth, back lat, lower height and upper height.

13. The method as recited in claim 8 wherein said configuration settings from said design of experiments software include tilt, lumbar, depth, back lat, lower height and upper height values.

* * * * *